US008991877B2

(12) United States Patent
Spiessl

(10) Patent No.: US 8,991,877 B2
(45) Date of Patent: Mar. 31, 2015

(54) DOOR LOCK FOR THE DOOR OF A HOUSEHOLD APPLIANCE

(75) Inventor: Georg Spiessl, Willhof-Altendorf (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 552 days.

(21) Appl. No.: 11/793,098

(22) PCT Filed: Nov. 30, 2005

(86) PCT No.: PCT/EP2005/012778

§ 371 (c)(1),
(2), (4) Date: Jun. 15, 2007

(87) PCT Pub. No.: WO2006/063684

PCT Pub. Date: Jun. 22, 2006

(65) Prior Publication Data

US 2008/0106105 A1 May 8, 2008

(30) Foreign Application Priority Data

Dec. 16, 2004 (DE) ..... 10 2004 060 607

(51) Int. Cl.

| | |
|---|---|
| ***E05C 1/06*** | (2006.01) |
| ***H01H 9/22*** | (2006.01) |
| ***A47L 15/42*** | (2006.01) |
| ***D06F 37/42*** | (2006.01) |
| ***D06F 39/14*** | (2006.01) |
| *E05B 15/02* | (2006.01) |

(52) U.S. Cl.

CPC ..... *H01H 9/226* (2013.01); *A47L 15/4259* (2013.01); *D06F 37/42* (2013.01); *D06F 39/14* (2013.01); *A47L 2501/22* (2013.01); *Y10S 292/69* (2013.01)

USPC ..... 292/144; 292/341.16; 292/DIG. 69

(58) Field of Classification Search

USPC ..... 292/144, 201, 341.16, DIG. 69; 335/186; 126/191, 197; 340/5.73, 3.1, 340/5.62, 542

See application file for complete search history.

(56) References Cited

U.S. PATENT DOCUMENTS

| | | | |
|---|---|---|---|
| 2,782,793 | A | 2/1957 | Bradley |
| 3,857,002 | A | 12/1974 | Lay et al. |

(Continued)

FOREIGN PATENT DOCUMENTS

| | | |
|---|---|---|
| DE | 20 59 318 | 5/1972 |
| DE | 34 23 083 | 1/1986 |

(Continued)

OTHER PUBLICATIONS

Computer Generated Translation of EP 0483697, http://gb.espacenet.com/search97cgi/s97_cgi.exe?Action=FormGen&Template=gb/EN/home.hts.*

(Continued)

*Primary Examiner* — Kristina Fulton
*Assistant Examiner* — Alyson M Merlino
(74) *Attorney, Agent, or Firm* — John C. Pokotylo; Straub & Pokotylo

(57) ABSTRACT

Door lock for a door of a household appliance with a first device for detecting a closed state of the door, and a second device for locking the door, wherein the first and second devices are electrically connected in series.

18 Claims, 7 Drawing Sheets

(56) References Cited

U.S. PATENT DOCUMENTS

| | | | | | |
|---|---|---|---|---|---|
| 3,892,933 | A | | 7/1975 | Rocchitelli | |
| 4,074,545 | A | | 2/1978 | Case | |
| 4,082,078 | A | * | 4/1978 | Thuleen et al. | 126/197 |
| 4,179,907 | A | | 12/1979 | Schantz | |
| 4,314,217 | A | * | 2/1982 | Krasser | 335/188 |
| 4,623,179 | A | * | 11/1986 | Davis et al. | 292/201 |
| 4,703,147 | A | * | 10/1987 | Happ et al. | 219/722 |
| 4,717,794 | A | * | 1/1988 | Paul et al. | 200/50.1 |
| 4,718,705 | A | | 1/1988 | Case | |
| 4,988,132 | A | * | 1/1991 | Rocchitelli | 292/144 |
| 4,995,650 | A | | 2/1991 | Schantz et al. | |
| 5,520,424 | A | * | 5/1996 | Hapke et al. | 292/198 |
| 5,879,036 | A | * | 3/1999 | Moline et al. | 292/210 |
| 6,036,241 | A | * | 3/2000 | Ostdiek et al. | 292/229 |
| 6,315,336 | B1 | * | 11/2001 | Swartzell | 292/201 |
| 6,334,637 | B1 | * | 1/2002 | Chioffi | 292/341.16 |
| 6,345,848 | B1 | * | 2/2002 | Baader et al. | 292/341.16 |
| 6,363,755 | B1 | * | 4/2002 | Hapke et al. | 68/12.26 |
| 6,575,505 | B1 | * | 6/2003 | Dimig | 292/216 |
| 6,603,377 | B2 | * | 8/2003 | Cho et al. | 335/186 |
| 6,863,316 | B2 | * | 3/2005 | Cole | 292/110 |
| 6,886,868 | B2 | * | 5/2005 | Hengelein et al. | 292/201 |
| 2007/0108777 | A1 | * | 5/2007 | Mueller et al. | 292/251.5 |
| 2007/0241568 | A1 | * | 10/2007 | Harrer | 292/144 |

FOREIGN PATENT DOCUMENTS

| | | |
|---|---|---|
| EP | 0 483 697 | 5/1992 |
| EP | 0 600 390 | 6/1994 |
| EP | 1 039 012 | 9/2000 |
| EP | 1 388 604 | 2/2004 |
| EP | 1 433 893 | 6/2004 |
| EP | 1 621 658 | 2/2006 |
| WO | WO 2005/106099 | 11/2005 |

OTHER PUBLICATIONS

Bibliographic Data for ITTO20040540A1—http://ep.espacenet.com/.*
Description for ITTO20040540A1—http://ep.espacenet.com/.*
Patent Family for ITTO20040540A1—http://search.proquest.com.*
Petitioner's "Notice of Opposition" to European Patent No. EP1834027, Opponent: Elettrotecnica Rold S.r.l. (29 pgs.) (dated Oct. 20, 2009).
EPO "Notice of Opposition to a European Patent" against European Patent No. EP1834027, Opponent: Elettrotecnica Rold S.r.l. (6 pgs.) (date stamped Oct. 22, 2009).
Petitioner's "Notice of Opposition Against European Patent EP1834027B1", Opponent: Illinois Tool Works Inc. (7 pgs.) (dated Oct. 20, 2009).
EPO "Notice of Opposition to a European Patent" against European Patent No. EP1834027, Opponent: Illinois Tool Works Inc. (4 pgs.) (date stamped Oct. 27, 2009).
Petitioner's "Notice of Opposition" to European Patent No. EP1834027, Opponent: Bitron S.p.A. (7 pgs.) (dated Oct. 21, 2009).
EPO "Notice of Opposition to a European Patent" against European Patent No. EP1834027, Opponent: Bitron S.p.A. (4 pgs.) (date stamped Oct. 26, 2009).
Clayton R. Paul, *Analysis of Linear Circuits*, ISBN 0-07-100263-4, pp. 28-31 (McGraw-Hill Book Company, 1989).
Opponent's Technical Drawing No. 53001 of SPL door locking device (3 pgs.).
Opponent's Technical Drawing No. 53002 of SPL door locking device (1 pg.).
Opponent's Technical Drawing Nos. 53500, 53503 and 53.504 of SPL door locking device (3 pgs.).
Invoice dated Oct. 1, 1980 relating to the product of the SPL series having code No. 53002 (1 pg.).
Elettrotecnica Rold' SPL series catalogue (10 pgs.).
Chamber Survey and Certificate of the Opponent (41 pgs.).

* cited by examiner

DOOR LOCK FOR THE DOOR OF A HOUSEHOLD APPLIANCE

FIELD OF THE INVENTION

The present invention relates in general to door locks for household appliances, in particular washing machines, dishwashers, driers and cookers, and especially a lock for doors of household appliances with three connection contacts.

BACKGROUND OF THE INVENTION

Door locks which comprise a device for detecting a closed state of a household appliance door, a device for locking and optionally for unlocking the household appliance door and a device for detecting a locked state of the household appliance door are known in the household appliance sector.

The device for detecting the closed state establishes whether the household appliance door (also door in brief in the following) is closed. In this respect a closed state of the door is to be understood as meaning that the door closes the associated opening of the household appliance, if necessary with a sealing action, i.e. is not just ajar. It is assumed in the following that the door must be in the closed state if it is to be locked. It is of course also possible for the door not to be locked when it is in the closed state.

If the door is in the closed state, for example when starting up the household appliance, the device for locking can be actuated in order to lock the closed door, i.e. to bring it into a state in which the door cannot be opened.

If the door is locked, this is recognised by the device for detecting the locked state.

The device for detecting the closed state of the door provides a signal which indicates that the door is closed. This signal indicates to a control of the door lock that the door is closed and can now be locked. The device for locking is subsequently activated by the control in order to lock the door. The device for detecting the locked state of the door provides a signal which indicates that the door is locked. This signal indicates to the control that the door can no longer be opened and it is accordingly possible to operate the household appliance.

A known door lock for washing machines is illustrated in detail with reference to FIGS. 1 to 3:

The door lock, which is designated as a whole by 100, has a housing shell 102 in which components which are described in the following are disposed. A housing lid, which is not represented, serves to close the equipped housing shell 102 and, together with the housing shell 102, forms the housing of the door lock 100.

A main slide 104, which can be displaced horizontally in the figures, is disposed in the housing shell 102. A main slide spring 106 acts on the main slide 104. The main slide 104 has a stop 108, the function of which is described in greater detail below.

A device of the door lock 100 for detecting the closed state of a household appliance door comprises a door contact switch 110. The door contact switch 110 has a first door contact 112 and a second door contact 114. If, as shown in FIG. 1, the first and second door contacts 112 and 114 are separated from one another, this indicates that the door is open. If, as shown in FIGS. 2 and 3, the first and second door contacts 112 and 114 contact one another, this indicates that the door is closed.

The first door contact 110 is disposed adjacent to a free end 116 of a first door contact conductor 118 formed as a leaf spring. The first door contact conductor 118 is biased to the right in the figures, i.e. the free end 116 exerts a force which is directed to the right. The end 120 of the first door contact conductor 118 which lies opposite the free end 116 is fastened to an inner end (not designated) of a first connection contact 122. This can take place by gluing, soldering or riveting, for example. The first connection contact 122 is formed as a rigid, stiff conductor. The end 120 of the first connection contact 122 which lies opposite the connecting point with the first door contact conductor 118 serves the purpose of connection to a plug connection, which is not represented, of the household appliance.

The second door contact 114 is disposed at one end 124 of a second door contact conductor 126. The second door contact conductor 126 is formed as a rigid, stiff conductor. Movements of the first and second door contacts 112 and 114 relative to one another are therefore possible on account of the flexible configuration of the first door contact conductor 118. The end 128 of the second door contact conductor 126 which lies opposite the end 124 forms a second connection contact 128 and serves the purpose of connection to the above-mentioned plug connection.

A device of the door lock 100 for detecting a locked state of a household appliance door comprises a locking contact switch 130. The locking contact switch 130 has a first locking contact 132 and a second locking contact 134. The first locking contact 132 is disposed adjacent to a free end 136 of a first locking contact conductor 138 formed as a leaf spring. The first locking contact conductor 138 is biased to the left in the figures, i.e. therefore exerts a force to the left. The end 140 of the first locking contact conductor 138 which lies opposite the free end 136 is fastened to a third connection contact 150 by soldering, gluing or riveting, for example. The end of the third connection contact 150 which lies opposite the connecting point with the first locking contact conductor 138 serves the purpose of connection to the above-mentioned plug connection.

The second locking contact 134 is disposed at one end 144 of a second locking contact conductor 146, which is formed as a stiff, rigid conductor. The opposite end of the second locking contact conductor 146 forms a fourth connection contact 142 and serves the purpose of connection to the above-mentioned plug connection.

A device of the door lock 100 for locking and unlocking the household appliance door comprises an electromagnetic actuator which is designated as a whole by 152. The actuator 152 has a magnet 154 with an armature, which is not represented. The control of and energy supply to the actuator 152 takes place by way of a fifth connection contact 156 and a sixth connection contact 158, which are formed as rigid, stiff conductors and serve the purpose of connection to the above-mentioned plug connection. The actuator 152 also has an actuating plunger 160 which is actively connected to the armature of the magnet 154 and can be actuated by this.

The locking and unlocking device also comprises a rotary slide 162 which serves to lock and unlock the main slide 104. The rotary slide 162 is rotatably mounted in the housing shell 102. A return spring 164, the function of which is described in detail in the following, can act on the rotary slide 162 in accordance with the position thereof. The rotary slide 162 has a prolongation 165 which, as illustrated in detail in the following, can interact with the first locking contact conductor 138 and with the return spring 164. A detent clip 166 can interact with the rotary slide 162 such that the rotary slide 162 is retained in a position which is suitable for locking, as described in detail in the following.

An electrical equivalent circuit diagram of the door lock 100 is shown in FIG. 4.

The operation of the door lock 100 is described in the following.

FIG. 1 shows the door lock 100 in a state in which the household appliance door is at least partly open, i.e. is neither in the closed nor in the locked state. In this state the main slide spring 106 acts on the main slide 104 such that this is pushed to the left. In this respect the main slide spring 106 is dimensioned such that, on account of an active connection of its end 116 with the structure 108, the first door contact conductor 118 is retained against its bias in the position which is shown in FIG. 1. The first and second door contacts 112 and 114 are as a result separated from one another. The door contact switch 110 is therefore open and indicates that the household appliance door is not closed.

The rotary slide 162 is retained in the position which is shown in FIG. 1 by a torsion spring, for example, which is not shown. In an embodiment which is not represented the return spring 164 is configured such that, for the state according to FIG. 1, it acts on the prolongation 165 and thereby retains the rotary slide 162 in the position which is shown in FIG. 1; it is then possible to dispense with the above-mentioned torsion spring, which is not shown. Here the rotary slide 162 acts by means of a prolongation or stop 170 against the biasing force of the first locking contact conductor 138 such that the first locking contact conductor 138 is retained in the position which is shown in FIG. 1. The first and second locking contacts 132 and 134 are separated from one another, the locking contact switch 138 is therefore open and indicates that the household appliance door is not locked.

FIG. 2 shows the door lock 100 in a state in which the household appliance door is closed, but not (yet) locked. The closure of the household appliance door causes the main slide 104 to be moved to the right against the force of the main slide spring 106. On account of its bias, the first door contact conductor 112 can in this case move such that the first and second door contacts 112 and 114 are brought into contact with one another. According to FIG. 2, this is achieved by the movement of the main slide 104 to the right terminating the active connection between the free end 116 of the first contact conductor 118 and the structure 108. The door contact switch 110 is now closed and indicates that the household appliance door is closed. The states of the rotary slide 162 and of the locking contact switch 130 have not changed in any way here with respect to FIG. 1.

FIG. 3 shows the door lock 100 in a state in which the household appliance door is closed and locked. This state is achieved by activating the actuator 152 in order to achieve a movement of the actuating plunger 160 to the left. The actuating plunger 160 then acts on the prolongation 165 and rotates the rotary slide 162 clockwise until a structure (e.g. a link connection), which is not represented, of the rotary slide 162 interacts with the detent clip 166 such that the rotary slide 162 is retained in the position which is shown in FIG. 3. The active connection between the prolongation 170 and the first locking contact conductor 138 is then terminated. On account of its bias, the first locking contact conductor 138 takes up the position which is represented in FIG. 3. The first and second locking contacts 132 and 134 are brought into contact with one another. The locking contact switch 130 is therefore closed and indicates that the household appliance door is locked.

In order to enable the household appliance door to be opened, the household appliance door has to be unlocked. The actuator 152 is activated again for this purpose. The resultant movement of the actuating plunger 160 to the left rotates the rotary slide 162 clockwise slightly against the action of force of the return spring 164, with the active connection of the structure, which is not shown, of the rotary slide 162 with the detent clip 166 being terminated and a rotation of the rotary slide 162 anti-clockwise being possible. The rotation of the rotary slide 162 back into its position which is represented in FIG. 2 or FIG. 1 takes place through the torsion spring, which was mentioned with reference to FIG. 1 and is not represented, and initially on account of the active connection between the return spring 164 and the prolongation 165. This rotation can also be effected by the return spring 164 alone, if this is configured such that it can also act on the prolongation 165 for the state according to FIG. 1.

The door lock 100, which is a representative example of known door locks of the type initially mentioned, has disadvantages like the latter. In order to connect the door lock 100, a plug connection with a total of 6 plug contact connection receptacles is required in order to accommodate the six connection contacts 122, 128, 142, 150, 156 and 158. The resultant construction space for a plug connection is a disadvantage, as corresponding construction space must also be provided on the household appliance side. The number of plug contact receptacles on the plug connection side is also a disadvantage, because—on the account of the structural and material expenditure—it entails corresponding production costs. This also applies to the actual door lock 1, where the total of six connection contacts entails corresponding construction space and expenditure.

A further disadvantage lies in the operational reliability of known door locks of this kind. If the actuator 152 is activated such that the rotary slide 162 is brought into the locking position which is shown in FIG. 3, although the door contact switch 110 is not closed, the door lock 100 may sustain damage if the household appliance door is closed when the door lock 100 is in a state of this kind.

Moreover, faulty operation of the household appliance as a whole may occur. If the actuator 152 is actuated as mentioned above, this results in the closure of the locking contact switch 130. The closed state of the locking contact switch 130 usually indicates to the household appliance control that startup is permissible. If, however, the household appliance door is not closed in a situation of this kind, injuries may occur through a drum rotating in the household appliance, water may escape in the case of household appliances carrying water and heat may escape in the case of driers and cookers.

OBJECT OF THE INVENTION

The object of the present invention is to provide a door lock for household appliances which can be produced in a simpler and more cost-effective way and which, moreover, also works more reliably.

BRIEF DESCRIPTION OF THE INVENTION

The present invention provides a door lock in order to achieve the above object.

A third device for detecting a locked state of the door is preferably provided.

The third device may be connected to the series connection of the first and second devices.

The second device also serves to unlock the door.

It is particularly preferable for the door lock as a whole to have just three connection contacts for electrical connections to the household appliance.

In this respect the first and second devices may be electrically connected to first and second connection contacts, respectively, of the door lock.

When using the third device, this can be electrically connected to a third connection contact of the door lock.

The first device preferably comprises a door contact switch with first and second contacts.

The first door contact may be disposed at a free end of a resiliently biased first door contact conductor.

The first door contact may also be connected to a first connection contact of the door lock in an electrically conductive manner.

The second device may be connected to the second door contact in an electrically conductive manner.

In one preferred embodiment the door lock comprises a main slide, which has or can take up a first position for a closed state of the door, and a stop region in order to interact with the first device.

Provision is in this case made for the main switch, in the first position, to retain the first and second door contacts in positions which are separate from one another. The main slide may also have a second position which indicates an open state of the door, in which case the main slide, in the second position, releases the first door contact for contacting the second door contact.

A main slide spring is preferably used in order to bias the main slide into the first position or into the second position.

The second device may comprise an actuator which has first and second actuator connections.

An electromagnetic actuator is preferably used.

The first actuator connection may be connected to the first device in an electrically conductive manner.

The second actuator connection may be connected to a second connection contact of the door lock in an electrically conductive manner.

The second device preferably comprises a rotary member and an actuating member by means of which the rotary member can be actuated when locking takes place.

The rotary member may have a lock-in structure which can interact with a detent member.

The rotary member may have a stop for interaction with the third device.

A lever provided on the rotary member is provided to interact with the actuator.

The third device preferably comprises a locking contact switch with first and second locking contacts.

The first locking contact may be disposed at a free end of a resiliently biased first locking contact conductor and/or connected to a third connection contact of the door lock.

The second locking contact is preferably connected to the second device in an electrically conductive manner.

The second device can release the first locking contact when locking takes place such that the first and second locking contacts can contact one another.

When the door is in an unlocked state the second device retains the first and second locking contacts in positions which are separate from one another.

BRIEF DESCRIPTION OF THE DRAWINGS

The present description and in particular the following description of preferred embodiments refer to the accompanying figures, in which.

DESCRIPTION OF PREFERRED EMBODIMENTS

Figure 1:
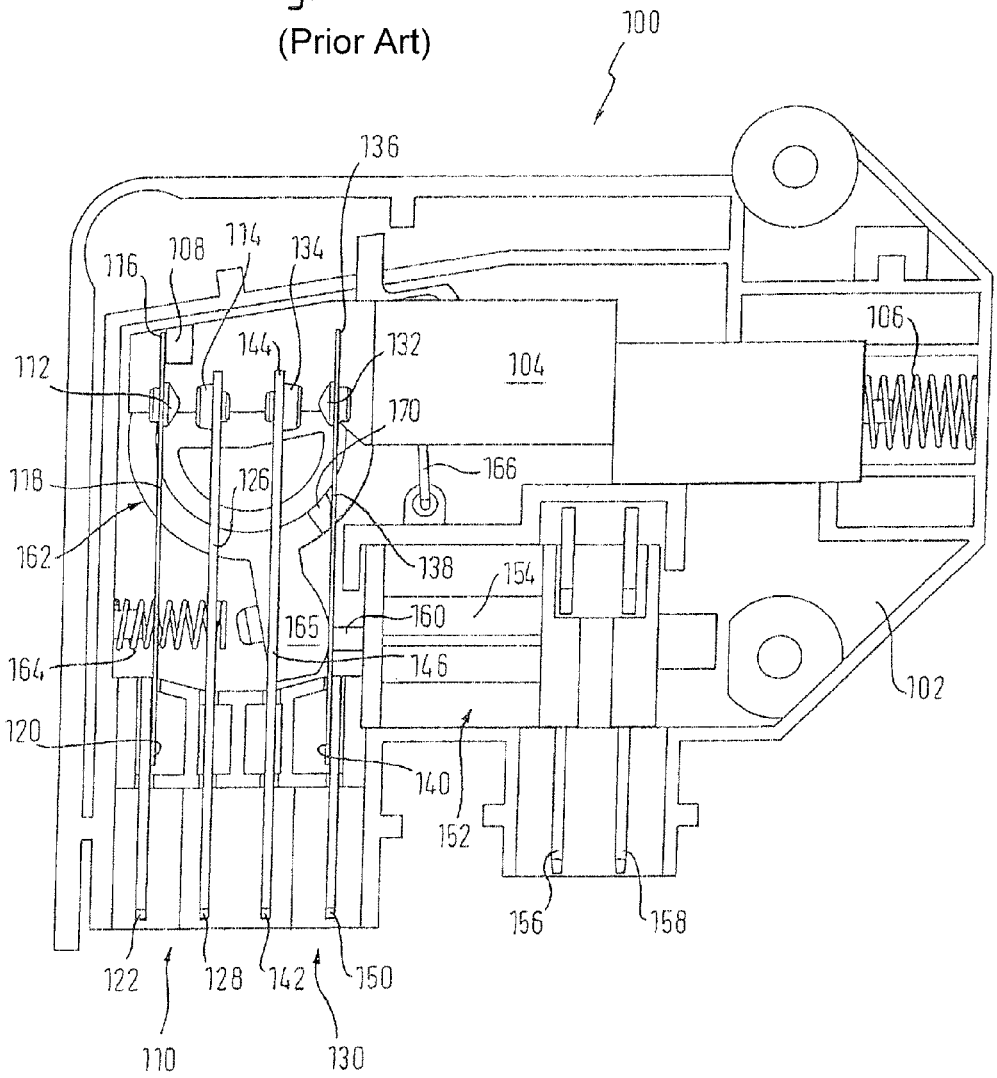
Fig. 1 (Prior Art)
FIG. 1 shows a known door lock with an unclosed and unlocked door.
Figure 2:
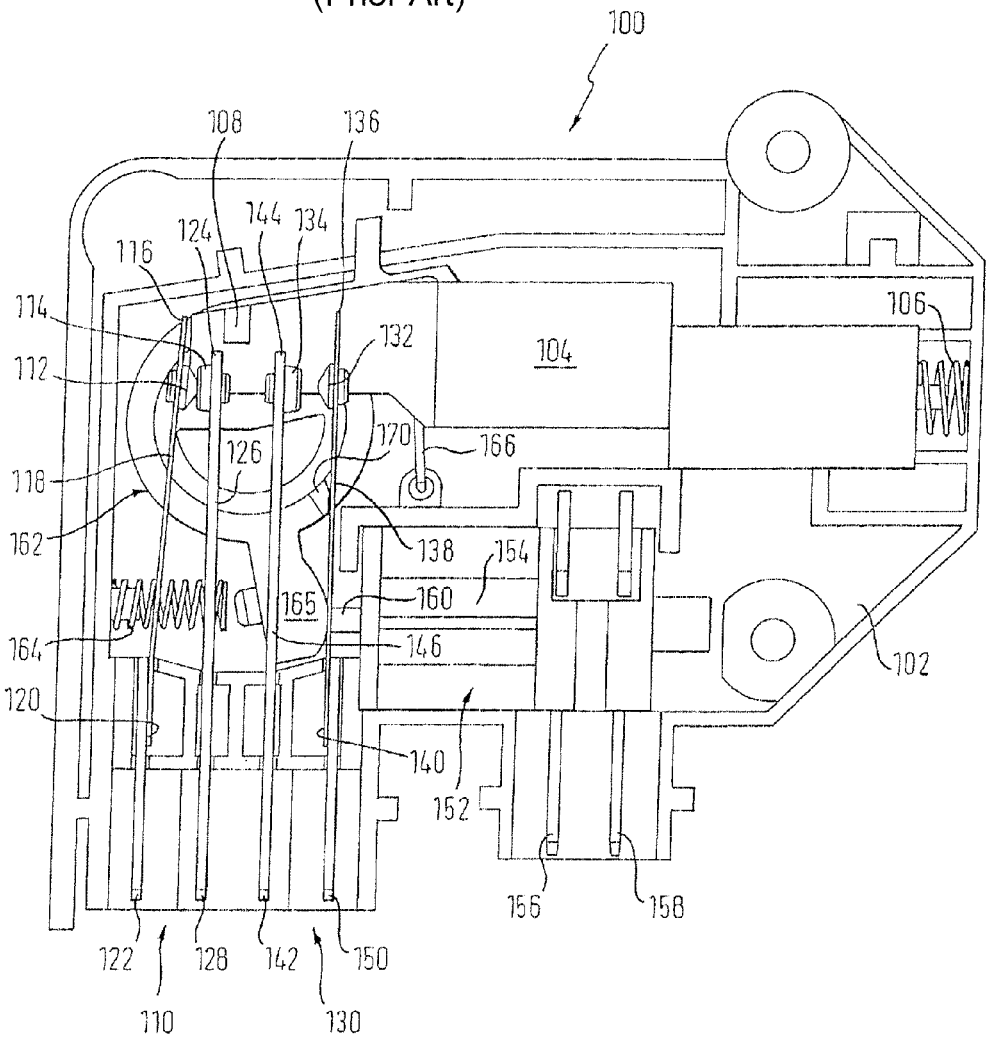
Fig. 2 (Prior Art)
FIG. 2 shows the known door lock of FIG. 1 with a closed door.
Figure 3:
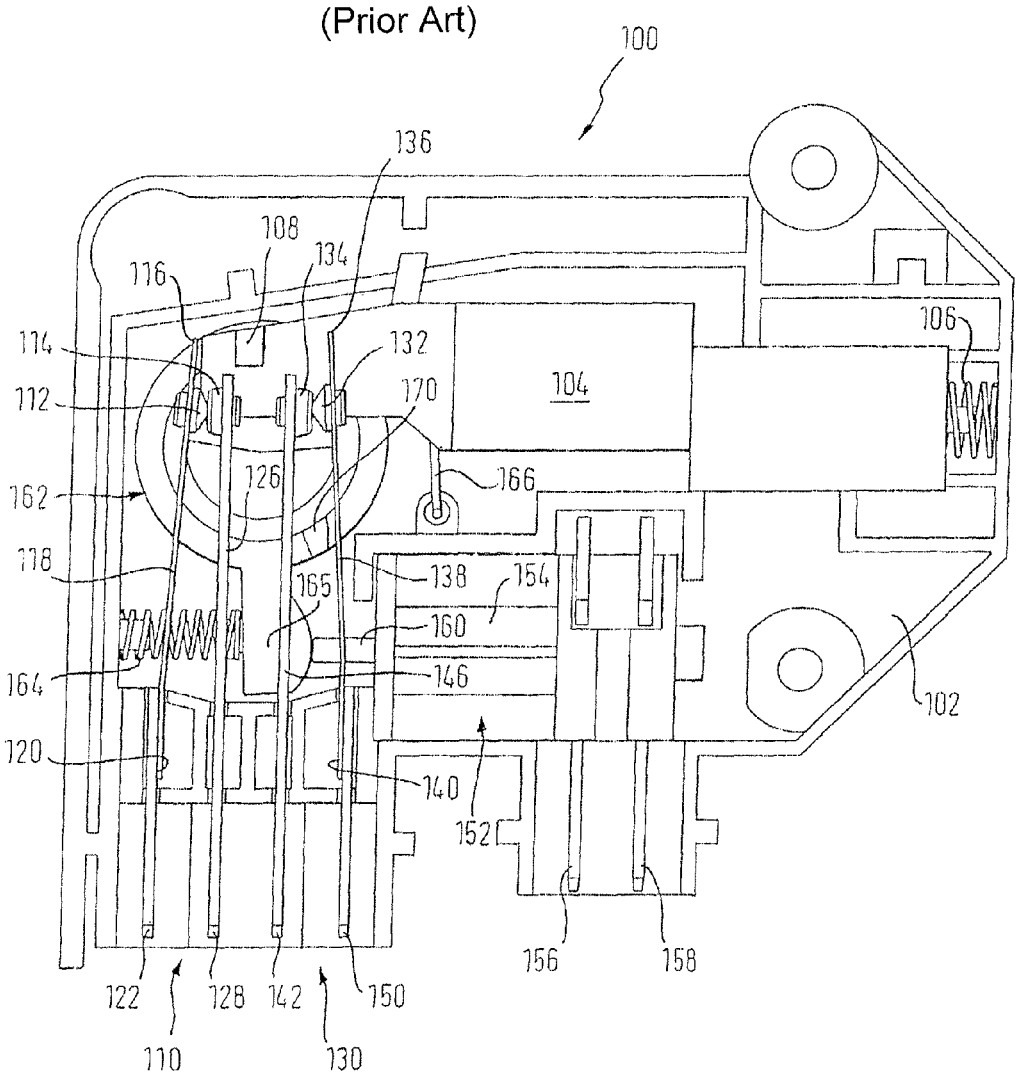
Fig. 3 (Prior Art)
FIG. 3 shows the known door lock of FIG. 1 with a closed and locked door.
Figure 4:
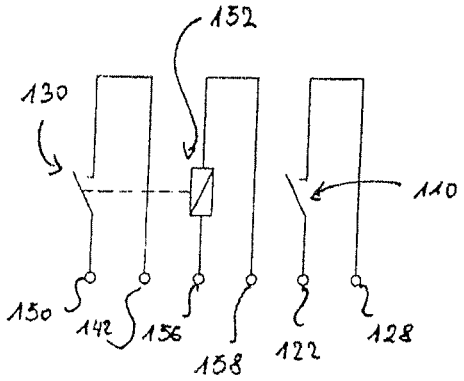
Fig. 4 (Prior Art)
FIG. 4 is a schematic representation of a circuit arrangement for use with the known door lock according to FIGS. 1 to 3.

A preferred embodiment of the door lock according to the invention and variants thereof are described with reference to FIGS. 5 to 7.

The door lock 1 comprises a housing shell 2, in which components of the door lock 1 which are mentioned in the following are disposed. The housing shell 2 can be closed by a housing lid, which is not shown and which, together with the housing shell 2, forms a housing of the door lock 1.

A main slide 4 is disposed in the housing shell 2 such that it can move horizontally in the figures. A main slide spring 6 acts on the main slide 4, pushing the main slide 4 to the right according to the figures. A stop region 8 is provided at the end of the main slide 4 which lies opposite its side which interacts with the main slide spring 6. As shown in the figures, the stop region 8 may be provided by this end of the actual main slide 4. The stop region 8 may also be provided in the form of a structure on the main slide 4 which extends substantially perpendicularly to the directions of movement of the main slide 4.

The door lock 1 has a door contact switch 10. The door contact switch 10 comprises a first door contact 12 and a second door contact 14. The first door contact 12 is disposed on a first door contact conductor 16. The first door contact conductor 16 is configured as a resilient element, for example in the form of a leaf spring. According to the figures, the first door contact conductor 16 is biased to the right. The first door contact 12 is disposed on the first door contact conductor 16 such that movements of the first door contact conductor 16 which are described in the following can bring the first and second door contacts 12 and 14 into contact with one another and separate them from one another.

As illustrated in the following, a free end 18 of the first door contact conductor 16 can interact with the stop region 8. The end 22 of the first door contact conductor 16 which lies opposite the free end 18 is connected to an inner end of the first connection contact 20 by soldering, gluing or riveting, for example. The arrangement of the second door contact switch 14 is described below. In this respect "inner" is understood as meaning the region and components which are not accessible from outside when the housing is closed (i.e. housing shell closed by housing lid); the equivalent applies to "outer".

The door lock 1 has a device for locking and unlocking a household appliance door with an actuator 24 which is formed as an electromagnetic actuator. The actuator 24 comprises a magnet 26 whose armature, which is not represented, interacts with an actuating member 28. Activation of the actuator 24 by energising the magnet 26 gives rise to movements of the actuating member 28 to the left according to the figures.

The actuator 24 has a first actuator connection 30 and a second actuator connection 32 for supplying energy. The first actuator connection 30 is connected to the second door contact 14 in an electrically conductive manner. As represented in the figures, this can be achieved, for example, by forming the first actuator connection 30 as a conductor which extends away from the actuator 24 and the free, outer end of which allows the second door contact 14 to be disposed.

The second actuator connection 32 is connected to a second connection contact 34 in an electrically conductive manner. This can be achieved by forming the second actuator connection 32 as a conductor which extends away from the actuator 24 and the free end of which serves as a third connection contact 34. It is also possible to provide the second actuator connection 32 as a connection point which is formed on the actuator 24 and is connected to an inner end of an electrical conductor which provides the second connection contact 34 at its opposite, outer end.

A rotary member 36 is also provided. The rotary member 36 can be actuated by the actuator 24, with rotations of the rotary member 36 thereby effected serving to lock and unlock the main slide 4. The rotary member 36 can rotate clockwise and anti-clockwise, with a spring, which is not represented, biasing the rotary member 36 in the anticlockwise direction.

The rotary member 36 has a lever 38 whose free end serves to actuate the rotary member 36 through the actuating member 28. The rotary member 36 also has a stop which is formed as a prolongation 40. A lock-in structure 42 which is formed or disposed on the rotary member 36 interacts with a detent clip 44.

The door lock 1 also has a locking contact switch 46. The locking contact switch 46 comprises a first locking contact 48 and a second locking contact 50. The first locking contact 48 is disposed on a resilient first locking contact conductor 52 which is formed as a leaf spring, for example. The first locking contact conductor 52 is fixed and connected to an inner end of a third connection contact 56 in an electrically conductive manner at its end 54 which is the lower end in the figures. The third connection contact 56 may also be provided by a corresponding, longer configuration of the actual first locking contact conductor 52. The opposite end 58 of the first locking contact conductor 52 is a free end which can move as described in the following. Movements of the end 58 enable the first and second locking contacts 48 and 50 to be brought into contact with one another and separated from one another.

The second locking contact 50 is disposed on a second locking contact conductor 60 opposite the first locking contact 48. The second locking contact conductor 60 is connected to the first connection contact 20 in an electrically conductive manner and, as represented in the figures, preferably formed in one piece with this. According to the figures, the end 22 of the first door contact conductor 16 is connected to the connection contact 20 by connecting the end 22 to the second locking contact conductor 60.

Figure 8:
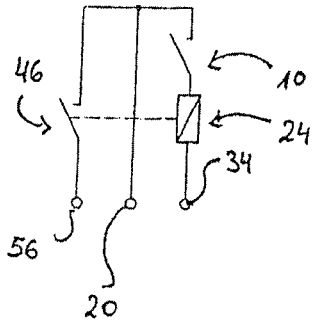
FIG. 8 is a schematic representation of a circuit arrangement for use with the door lock according to the invention.

For a basic understanding of the mode of operation of the door lock 1, reference is made to FIG. 8, which can be conceived as an electrical equivalent circuit diagram with regard to the door contact switch 10, the locking contact switch 46 and the actuator 24. The door contact switch 10 and the actuator 24 are electrically connected in series between the first connection contact 20 and the second connection contact 34. The locking contact switch 46 is connected between the first connection contact 20 and the third connection contact 56.

The door contact switch 10 is open as long as the household appliance door is not closed. The actuator 24 cannot then be activated by supplying energy by way of the first and second connection contacts 20 and 34.

If the household appliance door is closed, the door contact switch 10 closes in response to this. The first and second actuator connections 30 and 32 are then connected to the first and second connection contacts 20 and 34 in an electrically conductive manner. In this state the actuator 24 can be controlled by supplying energy by way of the first and second connection contacts 20 and 34, for example in the form of a pulse-like operation. As described in detail below, activation of the actuator 24 to lock the household appliance door causes the locking contact switch 46 to close. This is indicated in FIG. 8 by the broken line.

The locking contact switch 46 closed in response to locking establishes an electrical connection between the first and third connection contacts 20 and 56. The electrical connection of the first and third connection contacts 20 and 56 which is thus established indicates to a household appliance control that the household appliance door is locked and startup can take place.

The first connection contact 20 is preferably connected to earth. The second connection contact 34 is preferably connected to an electrical connection of a household appliance control by way of which control signals (e.g. pulse signals) can be supplied to the actuator 34. The third connection contact 56 is preferably connected to a connection of a household appliance control which has a predetermined potential which preferably differs from earth. If the locking contact switch 46 is closed, current flows between the first and third connection contacts 20 and 56. This flow of current indicates the locked state of the household appliance door.

Figure 5:
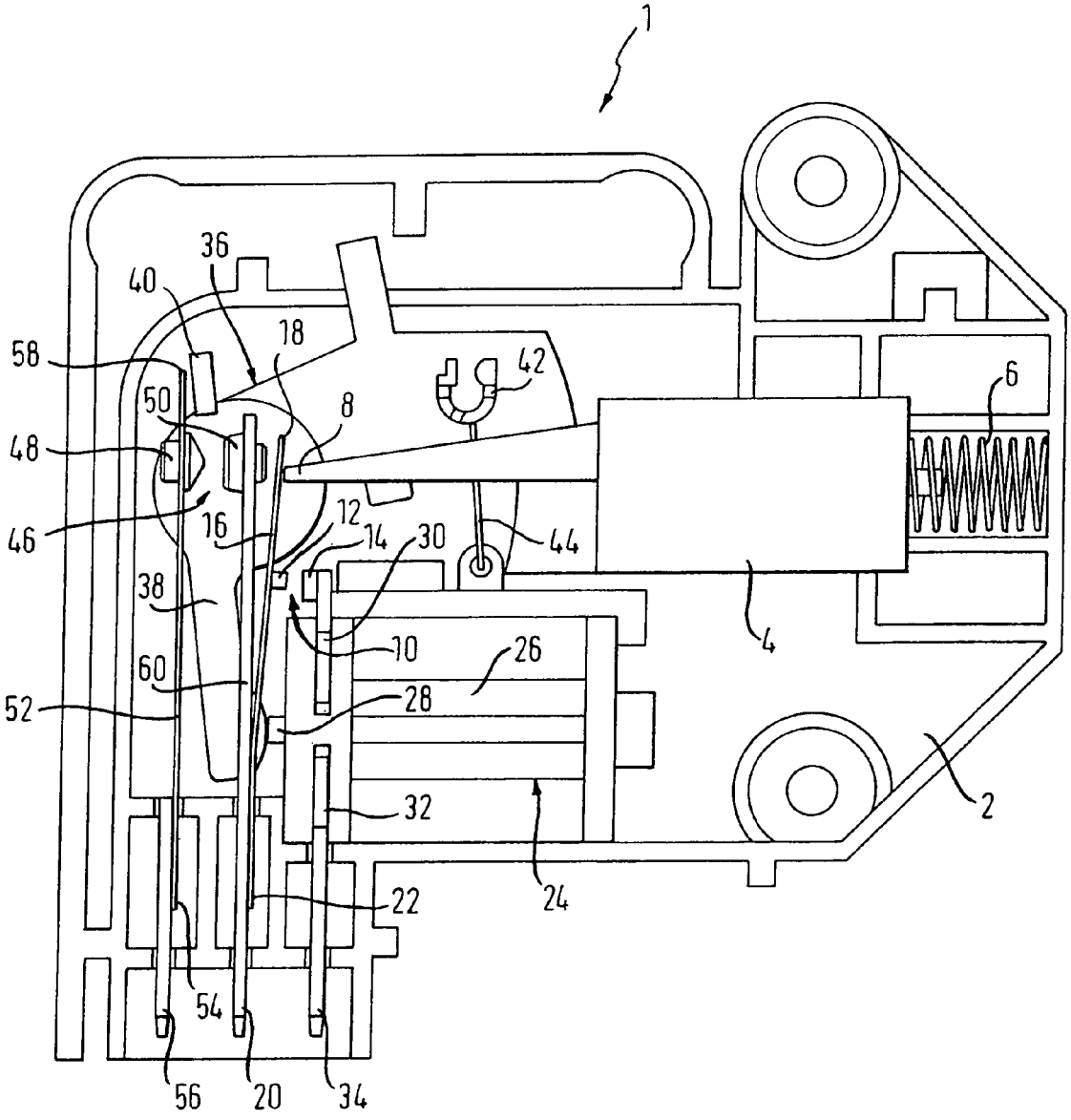
FIG. 5 shows an embodiment of the door lock according to the invention with an unclosed and unlocked door.
Figure 6:
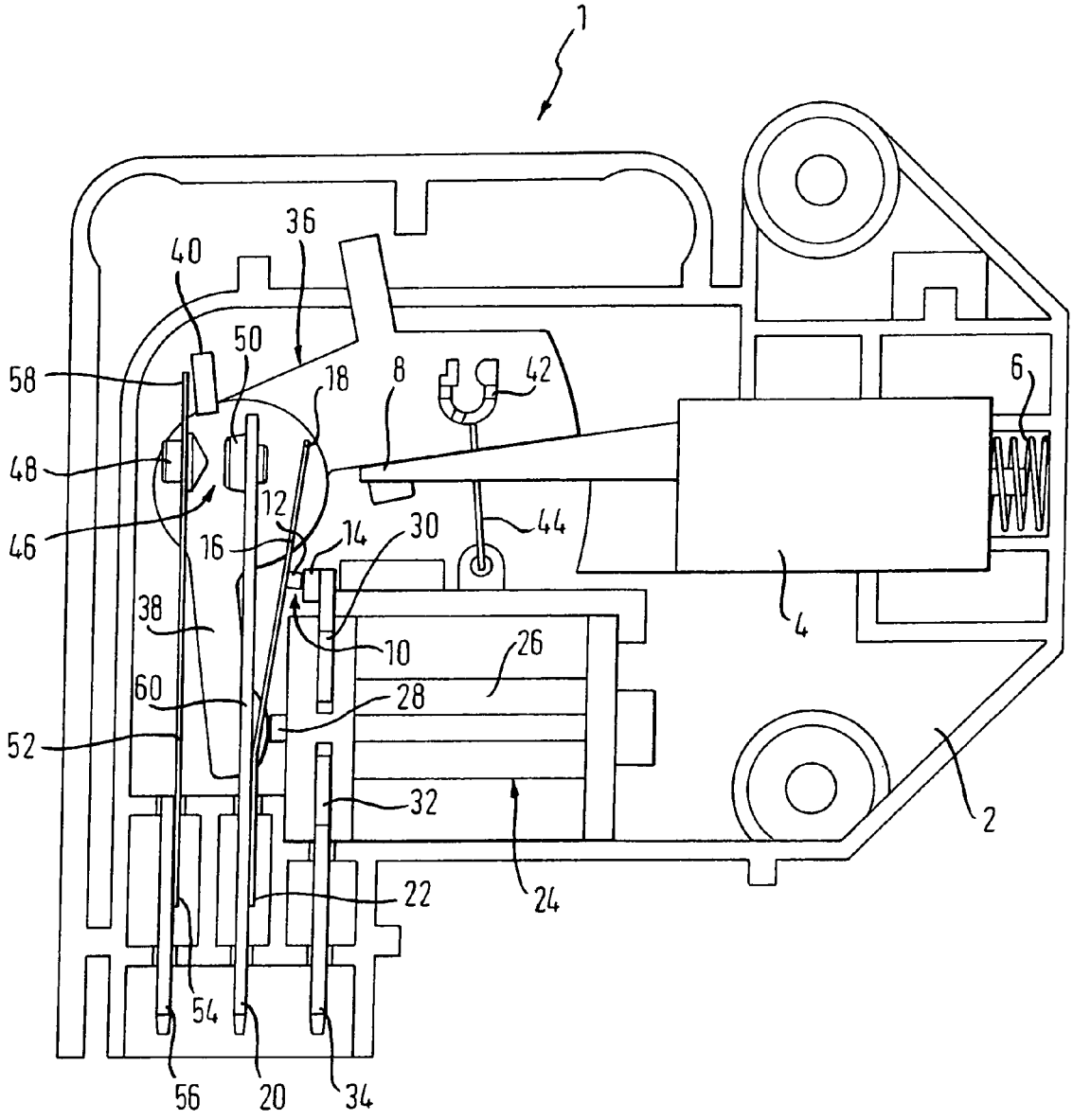
FIG. 6 shows the embodiment of FIG. 5 with a closed and unlocked door.
Figure 7:
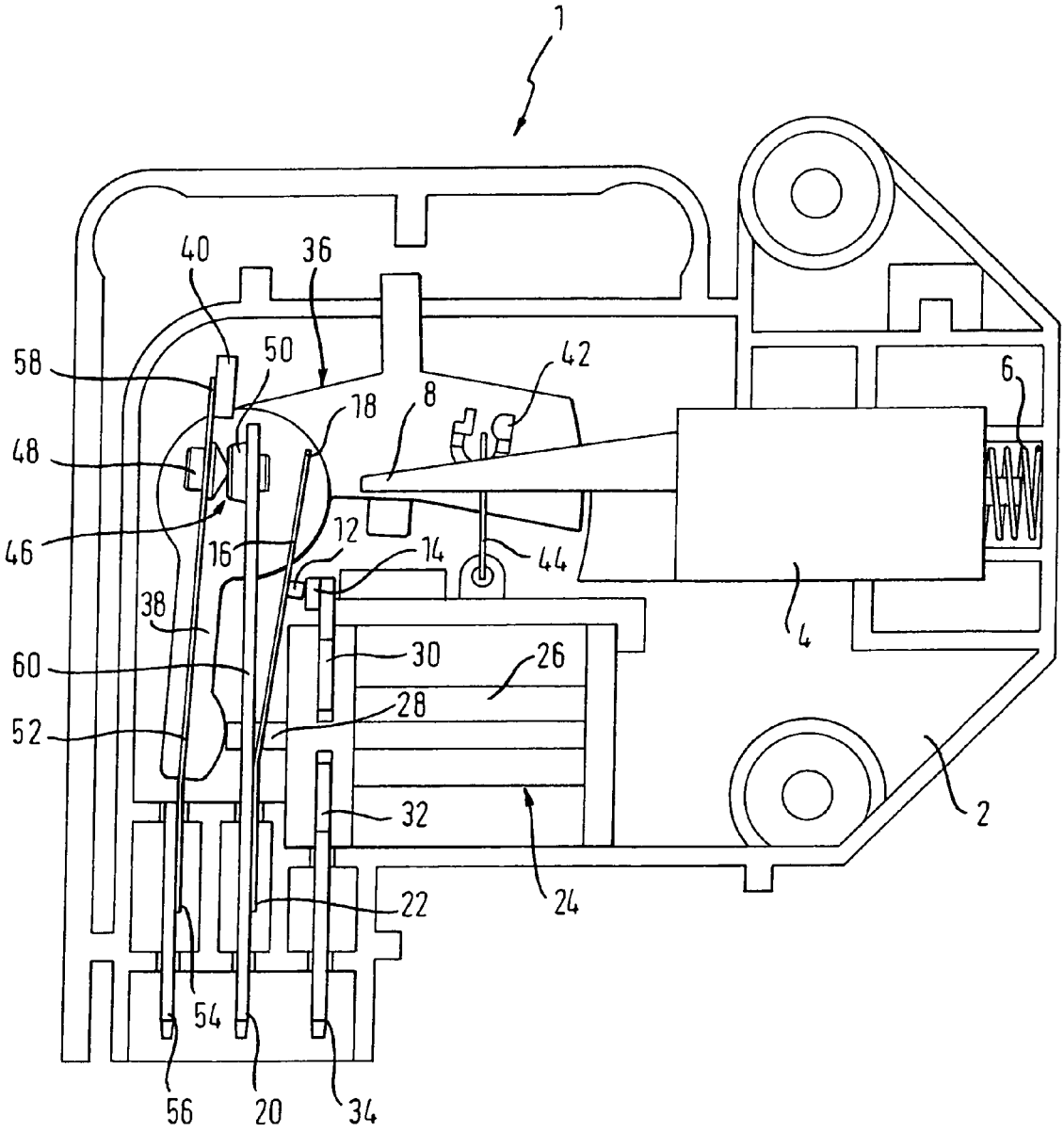
FIG. 7 shows the embodiment of FIG. 5 with a closed and locked door.

The mode of operation of the door lock 1, as illustrated in FIGS. 5 to 7, is described in greater detail in the following.

The door lock 1 is in the state which is shown in FIG. 5 when the household appliance door is neither completely closed nor locked. In this state the main slide spring 6 retains the main slide 4 in the represented position. The stop region 8 and the free end 18 of the first door contact conductor 16 then interact such that the first door contact conductor 16 is retained in the represented position against its bias. The first and second door contacts 12 and 14 are in this case separated from one another.

This indicates that the household appliance door is not closed. Any activation of the actuator 40 is impossible in this case.

When the door lock 1 is in the state according to FIG. 5 the free end of the lever 38 lies against the actuating member 28 on account of the action of force of the above-mentioned torsion spring, which is not represented, of the rotary member 36. The prolongation 40 and the free end 58 of the first locking contact conductor 52 then interact such that the first locking contact conductor 52 is retained in the represented position against its bias. The first and second locking contacts 48 and 50 are separated from one another. This indicates that the household appliance door is not locked. Current cannot flow between the first and third connection contacts 20 and 56.

The state of the door lock 1 which is represented in FIG. 6 corresponds to a situation in which the household appliance door is closed, but not locked. The closure of the household appliance door causes the main slide 4 to move to the right against the pressure force of the main slide spring 6. The active connection between the stop region 8 and the free end 18 of the first door contact conductor 16 is then terminated. The bias of the first door contact conductor 16 causes a movement into the position which is represented in FIG. 6.

The first and second door contacts 12 and 14 are as a result brought into electrically conductive contact with one another. The actuator 24 can be controlled on account of the resultant electrical connection between the first and second connection contacts 20 and 34. No changes occur with regard to the rotary member 36 and the locking contact switch 46 when the door lock 1 is in this state.

The state of the door lock 1 which is represented in FIG. 7 corresponds to a situation in which the household appliance door is closed and locked. In order to bring the door lock 1 into a state in which the household appliance door is locked, the actuator 24 is activated, which is possible on account of the electrical connection of the first and second connection contacts 20 and 34 by way of the closed door contact switch 10. The activation of the actuator 24 causes a movement of the actuating member 28 to the left, preferably in a pulse-like manner. The rotary member 36 is then rotated clockwise on account of the active connection with the actuating member 28 and the free end of the lever 38. The rotation of the rotary member 36, which also results in a displacement of the prolongation 40, causes the first locking contact conductor 52 to move on account of its bias into the position which is represented in FIG. 7. It is then possible for the active connection between the prolongation 40 and the free end 58 of the first locking contact conductor 52 to be terminated or, as shown in FIG. 7, for the prolongation 40 and the end 58 to remain in contact. When the first locking contact conductor 52 is in this position, the first and second locking contacts 48 and 50 contact one another in an electrically conductive manner, so that there is an electrically conductive connection between the first and third connection contacts 20 and 56.

The rotation of the rotary member 36 also causes the lock-in structure 42 and the detent clip 44 to interact such that the rotary member 36 is retained in the position which is shown in FIG. 7.

The actuator 24 is activated again in order to unlock the household appliance door.

The resultant, preferably pulse-like, movement of the actuating member 28 exerts a force on the rotary member 36 clockwise by way of the lever 38. This action of force, is which can cause the rotary member 36 to rotate further clockwise, results in the lock-in structure 42 and the detent clip 44 interacting such that the active connection which retains the rotary member 36 in the position which is shown in FIG. 7 is terminated. The rotary member 36 is subsequently brought by the above-mentioned spring, which is not represented, anticlockwise into the position which is shown in FIG. 5. The prolongation 40 then pushes the end 58 of the first locking contact conductor 52 into the position according to FIG. 6. The electrically conductive connection between the first and second locking contacts 48 and 50 is terminated. The absence of an electrical connection between the first and third connection contacts 20 and 56 indicates that the household appliance door is not locked (any more).

After unlocking the household appliance door, where the door lock 1 is in the state which is shown in FIG. 6, the household appliance door can be opened. Opening of the household appliance door causes the main slide spring 6 to push the main slide 4 out of the position which is shown in FIG. 6 into the position which is shown in FIG. 5. The stop region 8 then moves the free end 18 of the first door contact conductor 16 into the position which is shown in FIG. 5. The first and second door contacts 12 and 14 are then separated from one another. There is no electrically conductive connection between the first and third connection contacts 20 and 34. Activation of the actuator 34 is not possible (any more).

Diverging from the embodiment which is represented in FIGS. 5 to 7, it is possible to use, instead of the separated first door contact conductor 16 and second locking contact conductor 60, a conductor which is comparable with the first door contact conductor 16 and on which both the first door contact and the second locking contact are disposed.

It is also possible to use, instead of separate conductors for the connection contacts, one-piece conductors which provide, as integrated units, the connection contacts and door contact and locking contact conductors or actuator connections.

Provision is also made to firmly connect the first locking contact 48 to the rotary member 36 and dispose it such that a rotation of the rotary member 36 for locking the household appliance door brings the first and second door contacts into contact with one another.

Furthermore, embodiments are provided in which individual, a plurality of or all active principles are reversed in comparison with the embodiment of FIGS. 5 to 7, as far as this is possible. For example, one embodiment can have a locking contact switch whose open state (i.e. locking contacts 48 and 50 contact one another) indicates that the household appliance door is locked, while its closed state (i.e. locking contacts 48 and 50 do not contact one another) indicates an unlocked household appliance door.

The door lock according to the invention has various advantages.

The electrical series connection of the door contact switch and the actuator ensures that the actuator is also only actually activated when the household appliance door is closed.

Moreover, the number of connection contacts which are used is distinctly reduced. This results in a lower number of components, a reduced material requirement, a simpler structure and therefore in reduced production costs. The construction space in the region of the connection contacts is in addition decreased. However the reduced number of connection contacts also results in a decrease in the construction space required overall. The advantages obtained from the reduced number of connection contacts also apply to the connection which is provided on the household appliance side.

It is, nevertheless, still possible to detect the positions of the door contact switch 10 and/or of the locking contact switch 46 in order to establish whether the door contact switch 10 and the locking contact switch 46 are closed or open.

A further advantage becomes apparent in view of the following statements. Many household appliance manufacturers fit their household appliances according to price category with simple door locks whose doors are locked by means of a thermoelectric actuator (e.g. PTC element), or with door locks in the case of which doors are locked by means of an electromagnetic actuator.

Figure 9:
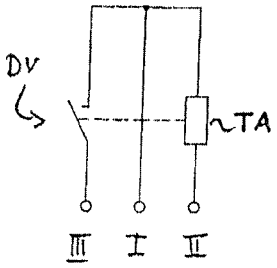
Fig. 9 (Prior Art)
FIG. 9 is a schematic representation of a circuit arrangement for use with a known door lock with a thermoelectric actuator.

As illustrated in FIG. 9, the simpler door locks with thermoelectric actuators have three connection contacts I, II and III. In contrast to the door locks discussed here, these door locks do not comprise any devices for establishing whether a household appliance door is closed. FIG. 9 represents in schematic form an electrical equivalent circuit diagram for a known door lock with a thermoelectric actuator TA in the form of a PTC element and a device DV for detecting a locked state.

It has until now been necessary, depending on whether door locks with a thermoelectric actuator or with an electromagnetic actuator are to be used, to provide various connection devices on the household appliance side, namely on the one hand connections with three contacts and on the other connections with six contacts. This is no longer necessary with the present invention. It is instead possible to use identical connections on the household appliance side irrespective of the type of door lock which is to be used. The present invention enables, for example, one and the same household appliance to be fitted either with a door lock according to the invention or with a known door lock with a thermoelectric actuator, without structural changes on the household appliance side being required in this respect.

The invention claimed is:

1. A door lock for a door of a household appliance, comprising:

a door contact switch which responds, automatically and regardless of whether or not there is any additional user input, to the closure of the door;

an electromagnetic actuator, which is electrically connected in series with the door contact switch, for actuating a door locking element; and a locking contact switch which responds to the door being locked or unlocked, wherein the door lock has only three connection contacts for electrical connection to a household appliance control, wherein the series connection of the door contact switch and the actuator is connected electrically between a first and a second connection contact, and the locking contact switch is electrically connected between the first and a third connection contact.

2. The door lock according to claim 1, wherein the first connection contact is electrically connected to earth.

3. The door lock according to claim 1, wherein the first connection contact is electrically connected to earth.

4. The door lock according to claim 1, wherein the locking contact switch is closed when the door is in the locked state.

5. The door lock according to claim 1, wherein the locking contact switch is closed when the door is in the locked state.

6. The door lock according to claim 2, wherein the locking contact switch is closed when the door is in the locked state.

7. The door lock according to claim 3, wherein the locking contact switch is closed when the door is in the locked state.

8. The door lock according to claim 1, wherein the series connection of the door contact switch and the actuator is fixed.

9. The door lock of claim 1, wherein the first connection contact is electrically connected to earth when the three connection contacts are electrically connected to the household appliance control such that the series connection of the door contact switch and the actuator is outside a current path extending from the third connection contact to the first connection contact via the locking contact switch.

10. A door lock for a door of a household appliance, the door lock comprising:

a door contact switch adapted to switch from an open switching state to a closed switching state in response to closure of the door automatically and regardless of whether or not there is any additional user input;

an electromagnetic actuator connected electrically in series with the door contact switch, for actuating a door locking element for locking the door;

a locking contact switch adapted to switch from a first switching state to a second switching state in response to actuation of the door locking element for locking the door; and only three connection contacts structurally adapted for connection of the door lock to a household appliance control, wherein the series connection of the door contact switch and the actuator is connected electrically between a first and a second of the connection contacts.

11. The door lock of claim 10, wherein one of the connection contacts is electrically connected to earth.

12. The door lock of claim 10, wherein the locking contact switch is an on/off switch.

13. The door lock of claim 10, wherein the first switching state of the locking contact switch is an open state and the second switching state of the locking contact switch is a closed state.

14. The door lock of claim 13, wherein the locking contact switch establishes a closed electrical connection between the first and third connection contacts in its closed state.

15. The door lock of claim 10, wherein the actuator includes first and second electrical connections, and wherein the door contact switch, in its closed switching state, establishes a closed electrical connection between the first connection contact and one of the first and second electrical connections of the actuator and a closed electrical connection between the second connection contact and the other of the first and second electrical connections of the actuator.

16. The door lock of claim 10, wherein an external electrical connection with the door lock consists of the three connection contacts.

17. The door lock of claim 10, wherein the series connection of the door contact switch and the actuator is fixed.

18. The door lock of claim 10, wherein the first connection contact is electrically connected to earth when the three connection contacts are electrically connected to the household appliance control such that the series connection of the door contact switch and the actuator is outside a current path extending from the third connection contact to the first connection contact via the locking contact switch.

* * * * *